US007050749B2

(12) United States Patent
Reihl

(10) Patent No.: US 7,050,749 B2
(45) Date of Patent: May 23, 2006

(54) DEVICE FOR FIXING TONER IMAGES ON A RECORDING MEDIUM IN AN ELECTROGRAPHIC PRINTER OR COPIER

(75) Inventor: Heiner Reihl, Freising (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 10/868,642

(22) Filed: Jun. 15, 2004

(65) Prior Publication Data

US 2004/0265022 A1 Dec. 30, 2004

(30) Foreign Application Priority Data

Jun. 26, 2003 (DE) ..... 103 28 858

(51) Int. Cl.
*G03G 15/20* (2006.01)

(52) U.S. Cl. ..... 399/335; 399/336

(58) Field of Classification Search ..... 399/67, 399/68, 69, 320, 335, 336, 337; 219/270
See application file for complete search history.

(56) References Cited

U.S. PATENT DOCUMENTS

| | | | | |
|---|---|---|---|---|
| 6,449,458 | B1 | 9/2002 | Lang et al. | |
| 6,646,231 | B1 * | 11/2003 | Hotta et al. | 219/270 |
| 2004/0005178 | A1 | 1/2004 | Frohlich | |

FOREIGN PATENT DOCUMENTS

| | | |
|---|---|---|
| DE | 198 27 210 | 12/1999 |
| WO | WO 01/98840 | 12/2001 |

* cited by examiner

*Primary Examiner*—Hoang Ngo
(74) *Attorney, Agent, or Firm*—Schiff Hardin LLP

(57) ABSTRACT

In a device for fixing toner images on a recording medium in a printer or copier, fixing takes place with aid of a heat radiation source comprising ignition elements arranged in a heating module. Since the ignition elements are small, radiation areas of differing geometric extension can be created by their arrangement in the heating module.

18 Claims, 3 Drawing Sheets

DEVICE FOR FIXING TONER IMAGES ON A RECORDING MEDIUM IN AN ELECTROGRAPHIC PRINTER OR COPIER

BACKGROUND

Devices for fixing toner images on a recording medium (fixing station) for electrographic printers or copiers, with which devices toner images are fixed on a recording medium, for example paper, are known. An example of such a device is described in DE 198 27 210 C1. In this document, various fixing methods are likewise described. For example, fixing can be achieved by way of heat-pressure-fixing, in which the toner images are heated on the recording medium by a heating device and are then firmly bonded under pressure to the recording medium by fixing drums. In order to accelerate the fixing operation, a preheating saddle with which the recording medium and the toner images are preheated can be arranged upstream of the heating device. Further, the fixing can be effected by heating modules, which emit heat radiation directed to the recording medium and the toner images. Examples of such heating modules are foil radiators or ceramic panel radiators. These can be used with or without a preheating saddle. A detailed description of these fixing methods can in particular be taken from the document DE 198 27 210 C1 or WO 01/98840, which are incorporated by reference into the present application.

With the speed increase in printers making use of heat-pressure fixing rising more and more, problems arise regarding the preheating of the recording medium, since altogether enough heat energy for fixing is transferred with increasingly decreasing interaction time in the gap between the fixing drums. As a result, the length of the preheating saddle (contact heat transfer) would have to be increased and its temperature would have to be raised, which—for constructural reasons—is not always possible to a sufficient extent. In addition, when using printers in Twin Systems and when printing on both sides, a problem arises in particular during standstill. Since at higher printing speeds, the cooling time between the successive printers in the Twin System decreases, the recording medium comes to a halt in the second printer with an increased temperature in the case of a print stop and takes up additional heat while lying on the heating saddle of the second printer. When printing on both sides, the printed recording medium will in some cases stick on the backing due to the direct contact between the toner and the preheating saddle. As a result, the recording medium tears upon reapplication, and toner adhering on the preheating saddle has to be cleaned off at great expense.

The above-mentioned problem can be avoided by an optimized temperature control in the heating device. However it is difficult to achieve such a temperature control in known heating devices due to additional dependencies such as paper moisture, indoor climate, paperweight etc.

SUMMARY

A system and method is provided having a heater which includes a heating module that can be controlled almost instantaneously. The heating module is arranged close to the recording medium and has controllable ignition elements.

DESCRIPTION OF THE PREFERRED EMBODIMENTS

Figure 1:
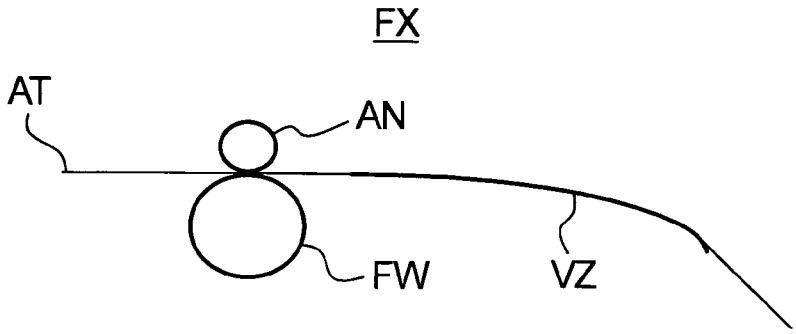
FIG. 1 (PRIOR ART)
FIGS. 1 and 2 illustrate known heating devices.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The heating module combines a high power per unit surface with a high temperature and a fast controllability. As radiation sources, ignition elements, for example, silicon nitride ignition elements (SN Heater) are used. These are high impedance heating circuits embedded in silicon nitride ceramics and can be operated at mains voltage and in a voltage-controlled manner. They guarantee that enough heating power can be provided within a short time. The yield of radiation heat increases disproportionately to the power of four with increasing temperature, and thus over a short distance a high power per unit surface can be achieved by high temperature gradients.

The heating module designed in this way can be used both for heating a preheating saddle and for the actual fixing of the toner images.

Since the dimensions of the ignition elements are small, the structure of the heating module as well as the electric control of the ignition elements can be easily adapted to the width of the recording medium, and it is convenient to provide zone formations of the electric circuits that are allocated to different widths of the recording medium. According to the demands on the heating module, different geometric designs can be implemented without great expense. The ignition elements can be arranged in a row transverse to the recording medium. In order to subject a greater area to heat radiation, it is advantageous to arrange several rows one behind the other, as viewed in a transport direction of the recording medium. For a uniform irradiation of the area to be heated, it is possible to arrange the ignition elements in successive rows, which are offset with respect to one another. It is, however, likewise possible to arrange the ignition elements at an angle to the recording medium such that the ignition elements overlap one another in the connection areas. Another implementation of the heating module can be such that the ignition elements are perpendicular to the recording medium, the radiation area being directed to the recording medium. Then, it is useful when the individual ignition elements, and in particular at least their radiation area, are each surrounded by a radiation reflector, or when all ignition elements of one row and/or column are jointly surrounded by one radiation reflector.

When such a heating module is installed above the recording medium, the risk of a direct contact in case of malfunctions above ignition temperature is excluded, if corresponding safety precautions are taken, such as movable safety blinds between the heating module and the recording medium.

Figure 2:
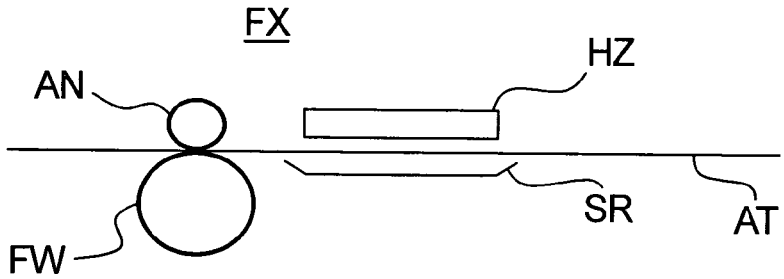
FIG. 2 (PRIOR ART)

In FIGS. 1 and 2, known methods of fixing toner images on a recording medium AT with the aid of heat are illustrated. According to FIG. 1, a recording medium AT is guided through a fixing device FX having a preheating saddle VZ and fixing rollers FW, namely a pressure roller AN and a heated roller FW. The recording medium AT is preheated on the preheating saddle VZ so that the toner images are firmly joined to the recording medium AT by the fixing rollers FX, AN.

In FIG. 2, the preheating saddle VZ has been replaced by a radiation heating HZ of common structure, a radiation reflector SR being arranged opposite the radiation heating HZ.

Figure 3:
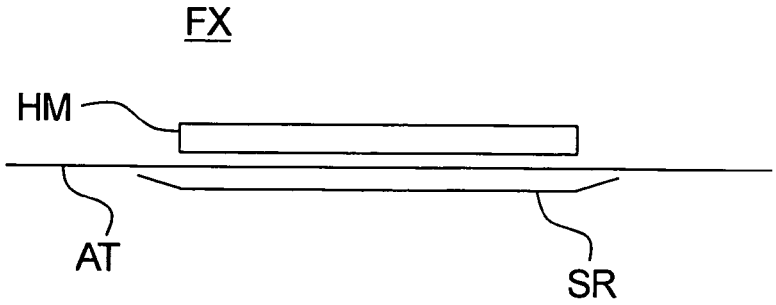
FIG. 3 is a schematic diagram of a heating module comprising ignition elements.

A schematic diagram of the preferred embodiment is shown in FIG. 3, in which the radiation heating is implemented by a heating module HM comprised of ignition elements ZE. The ignition elements ZE are individual elements, which can be arranged with respect to one another in an arbitrary order in order to achieve a radiation area corresponding to the case of application. Such ignition elements are known and are, for example, commercially available as an SN heater (silicon nitride heater) or a ceramic glow plug. These are, for example, used in the field of ignition of diesel engines. They are high-impedance heating circuits embedded in silicon nitride ceramics and can be operated at mains voltage and in a voltage-controlled manner. These ignition elements can be implemented as panel elements having, for example, a width of 4–50 mm, a thickness of 1–20 mm and a length of 30–80 mm, and the radiation area can amount to 25% to 33% of the area. They allow a temperature rise from room temperature to 1500K in still air within 20 sec with a power per unit surface of 70 $W/cm^2$. With a length of 10 cm and a width of 50 cm, they can achieve a radiation power of 9 kW, it being assumed that only half of the radiation is directed to the desired side and the area filling factor is 50%. Due to the small dimensions of the ignition elements, arbitrary heating modules can be formed which are adapted to the respective case of application. Thus, because of the small individual elements, an adaptation to the printing width in the cm raster is possible. Since the ignition elements are quite thin, the decay behavior after a power outage is likewise short. With such a heating module, a complete fixing of the toner images can thus be achieved, since a radiation area of 0.25 $m^2$ provides a heating power of 40 kW.

In FIG. 3, the heating module HM comprised of individual ignition elements ZE is arranged above the recording medium AT, while a radiation reflector SR is provided below the recording medium.

Figure 4:
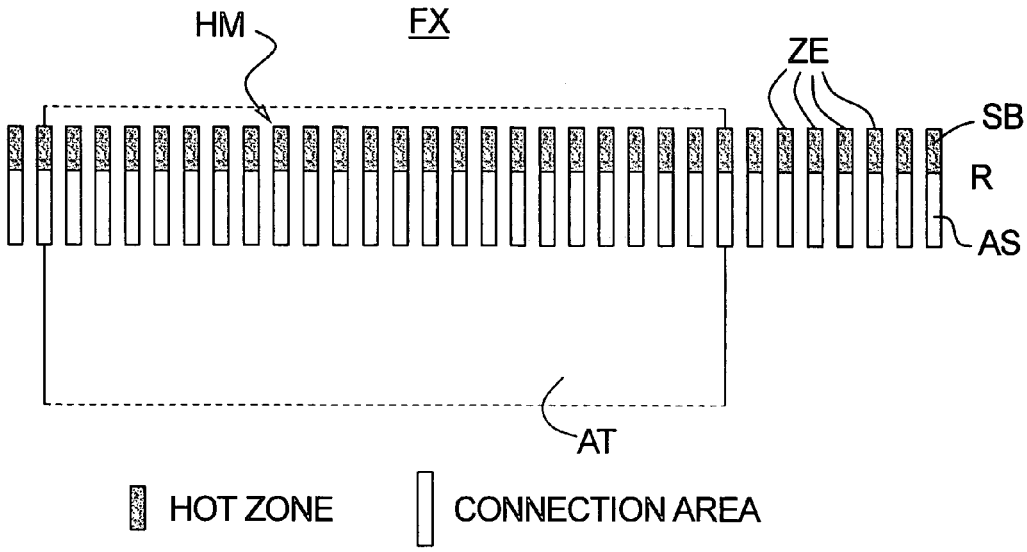
FIG. 4 is a schematic diagram of a heating module comprising ignition elements arranged in a row.

A possible embodiment of the heating module HM can be seen in FIG. 4. Here, the ignition elements ZE are arranged side-by-side in one row R transversely to the recording medium AT, the ignition elements ZE being parallel to the recording medium AT. The radiation region SB of the ignition elements ZE is grey-shaded and followed by the connection region AS. The width of the heating module HM is selectable, and in addition it is possible to adjust the radiation width of the heating module HM by electric activation of the individual ignition elements ZE. This is illustrated in FIG. 4, in which the width of the heating module HM is larger than the width of the recording medium AT. When only the ignition elements ZE lying above the recording medium AT are activated, the radiation area of the heating module HM is adapted to the recording medium AT.

Figure 5:
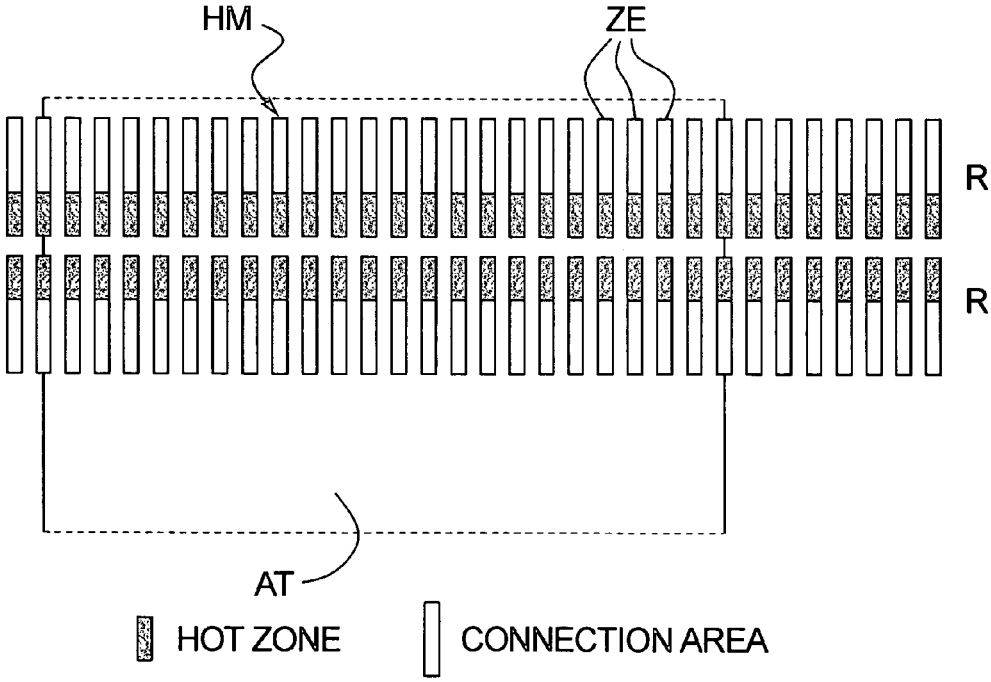
FIG. 5 is a schematic diagram of a heating module comprising ignition elements arranged in two rows.

In a second embodiment according to FIG. 5, two rows R of ignition elements ZE are provided, the result being a heating module HM having a higher power. These rows are arranged one after the other. Of course, further rows of ignition elements can be provided, the location of the individual ignition elements being selectable, for example, and the ignition elements of successive rows can also lie offset with respect to one another. Again, the ignition elements ZE are arranged parallel to the recording medium AT.

Figure 6:
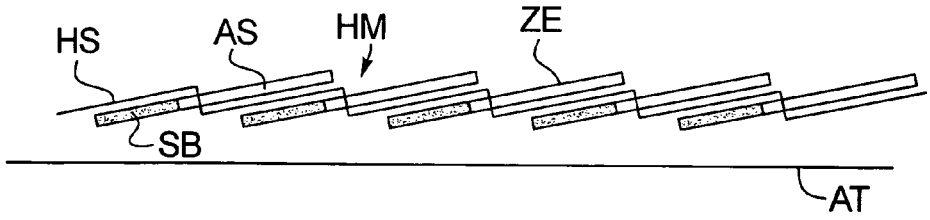
FIG. 6 is a schematic diagram of a heating module comprising ignition elements arranged in a row and lying at an angle to the recording medium.

In order to achieve a complete irradiation of the recording medium AT, the ignition elements ZE can be arranged at an angle to the recording medium AT in the heating module HM, FIG. 6. By means of a corresponding arrangement of the ignition elements ZE, thus a complete irradiation of the recording medium AT can be achieved. In this embodiment, the radiation region SB of the ignition elements ZE can be shielded from their connection region AS by means of a heat shield HS. According to this principle, a large-area heating module for exclusive radiation fixing can be implemented.

Figure 7:
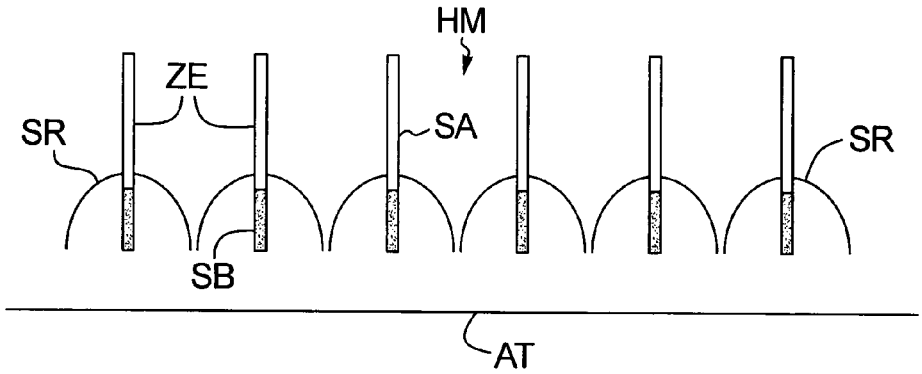
FIG. 7 is a schematic diagram of a heating module comprising ignition elements arranged in a row and being perpendicular to the recording medium.

A further embodiment is shown in FIG. 7. Here, the ignition elements ZE are arranged side-by-side and perpendicular to the recording medium AT, each ignition element ZE, at least its radiation region SB, being surrounded by a radiation reflector SR. Of course, the radiation reflector can surround several ignition elements or all ignition elements. By this structure, a large-area heating module can likewise be implemented.

Figure 8:
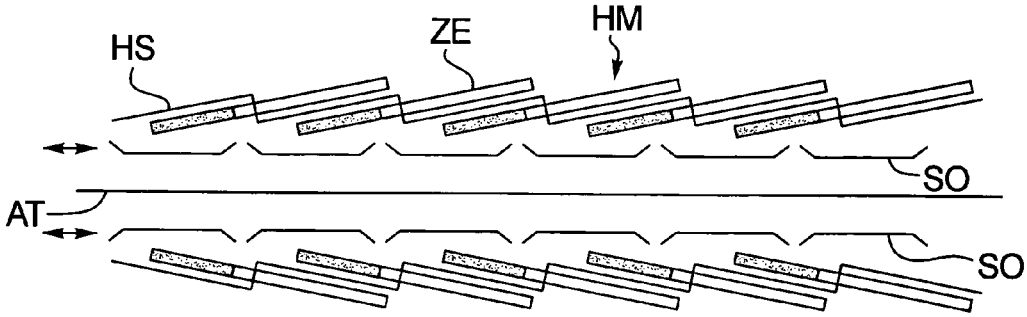
FIG. 8 is a schematic diagram of two heating modules, one on each side of the recording medium, one safety blind each being additionally movable between the recording medium and the heating module.

FIG. 8 illustrates an embodiment in which two heating modules HM are provided, one on each side of the recording medium AT. The heating modules HM are designed as shown in FIG. 6. In order to avoid an unnecessary heating of the recording medium AT, one safety blind SO can be moved between the recording medium AT and the heating module HM.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

I claim as my invention:

1. A device for fixing toner images on a recording medium in a printer or copier, comprising:

a heater having at least one heating module implemented as a heat radiation source, the heating module being arranged close to the recording medium; and the heating module having juxtaposed spaced apart individual controllable ignition elements separated by gaps, a number of said elements provided being dependent on an area of the recording medium that is to be heated.

2. A device according to claim 1 wherein the ignition elements comprise heating circuits embedded in silicon nitride ceramics.

3. A device according to claim 1 wherein the ignition elements have a width of approximately 4–50 mm, a length of approximately 30–80 mm, a thickness of approximately 1–20 mm, and radiation area amounting to approximately 25 to 33%.

4. A device according to claim 1 wherein the ignition elements are operated at mains voltage.

5. A device according to claim 1 wherein the heating module is provided for heating a preheating saddle.

6. A device according to claim 1 wherein the heating module is provided for fixing the toner images on the recording medium.

7. A device according to claim 1 wherein the heating module has one row of juxtaposed heating elements which are at least arranged over a width of the recording medium.

8. A device according to claim 1 wherein the heating module has at least two rows of juxtaposed ignition elements, which are at least arranged over a width of the recording medium.

9. A device according to claim 8 wherein the ignition elements of successive rows of ignition elements are arranged offset with respect to one another.

10. A device according to claim 1 wherein the heating module has at least one row of juxtaposed ignition elements which are arranged at an angle to the recording medium such that connection regions of the ignition elements overlap one another.

11. A device according to claim 1 wherein the heating module has at least one row of juxtaposed ignition elements which are arranged perpendicular to the recording medium, a radiation area being close to the recording medium.

12. A device according to claim 11 wherein the individual ignition elements have a radiation reflector allocated to them.

13. A device according to claim 11 wherein the ignition elements are surrounded by a common radiation reflector.

14. A device according to claim 1 in which a width of the arrangement of the ignition elements in the heating module is larger than a width of the recording medium and in which a width of a radiation area of the heating module is adjustable by activation of the ignition elements.

15. A device according to claim 1 in which on both sides of the recording medium one heating element is arranged.

16. A device according to claim 1 in which between the respective heating module and the recording medium a safety blind is movably arranged.

17. A device for fixing toner images on a recording medium in a printer or copier, comprising:

a heater having at least one heating module arranged adjacent the recording medium;

the heating module having a plurality of spaced apart individual controllable ignition elements separated by gaps and arranged in a line transverse to a moving direction of the recording medium, each of said individual elements having a temperature rise from room temperature of 1500° K. in still air within 20 seconds; and a radiation reflector opposite the heating module such that the recording medium lies between the radiation reflector and the heating module.

18. A method for fixing toner images on a recording medium in a printer or copier, comprising the steps of:

providing a heating module positioned adjacent to the recording medium;

providing the heating module with a plurality of spaced apart individual controllable ignition elements separated by gaps and arranged across a lateral width of the recording medium, each of said individual elements having a temperature rise from room temperature to 1500° K. in still air within 20 seconds after energy is applied to the ignition elements; and selectively energizing the ignition elements to fix toner images on the recording medium.

* * * * *